United States Patent [19]

Watanabe et al.

[11] Patent Number: 4,639,212

[45] Date of Patent: Jan. 27, 1987

[54] SWIRLING DEVICE FOR STIRLING CYCLE ENGINES

[75] Inventors: Tetsumi Watanabe, Okazaki; Akira Yamaguro, Anjyo; Susumu Yamaguchi, Kariya, all of Japan

[73] Assignee: Aisin Seiki Kabushiki Kaisha, Kariya, Japan

[21] Appl. No.: 679,453

[22] Filed: Dec. 7, 1984

[30] Foreign Application Priority Data

Dec. 9, 1983 [JP] Japan ..... 58-189271[U]

[51] Int. Cl.[4] ..... F23M 9/00

[52] U.S. Cl. ..... 431/183; 239/406; 60/517

[58] Field of Search ..... 431/183; 239/405, 406; 60/517

[56] References Cited

U.S. PATENT DOCUMENTS

| | | | |
|---|---|---|---|
| 1,449,840 | 3/1923 | Reid | 431/183 |
| 2,054,162 | 9/1936 | Macrae | 431/183 |
| 4,081,233 | 3/1978 | Kitajima et al. | 431/183 |
| 4,083,674 | 4/1978 | Holzapfel | 431/183 |
| 4,155,701 | 5/1979 | Primas | 431/183 |
| 4,351,632 | 9/1982 | Nagai | 431/183 |

*Primary Examiner*—Carroll B. Dority, Jr.

*Attorney, Agent, or Firm*—Burns, Doane, Swecker & Mathis

[57] ABSTRACT

A burner for a stirling cycle engine which includes an air inlet port, an exhaust port and a combustion chamber between the inlet port and the exhaust port, the combustion chamber having an inlet provided with a swirl producing device including a pair of spaced apart, substantially parallel plates respectively formed with central apertures respectively having centers which are substantially aligned with each other, a plurality of spiral guide vanes disposed between the parallel plates. Each of the guide vanes has a curvature in which a tangent line at a point on the guide vane makes with a straight line passing through the point and the center of the central aperture an angle which is substantially constant and between 30° and 80° so that each two adjacent guide vanes define an inlet passage which is gradually decreased in area toward the central aperture. The inlet passage is communicated at an end adjacent to the central apertures with the combustion chamber and at the other end with the inlet port.

1 Claim, 5 Drawing Figures

SWIRLING DEVICE FOR STIRLING CYCLE ENGINES

BACKGROUND OF THE INVENTION

1. Field of the Invention

The present invention relates to a swirling device for a stirling cycle engine, and more particularly to a swirling device for producing a swirl in the air stream which is introduced into the combustion chamber of a stirling cycle engine.

2. Descriptions of Prior Art

A stirling cycle engine is a kind of external combustion engine which includes a combustion chamber for burning fuel therein to produce a heat which is used to heat a working gas through a heat exchanger. In this type of stirling cycle engine, it is essential, in accomplish an improved thermal efficiency, to improve the efficiency of combustion in the combustion chamber as well as the efficiency of the heat exchanger. In an effort to improve the efficiency of combustion, conventional stirling cycle engines include a swirling device in the passage of intake air into the combustion chamber to produce a swirl of the intake air. Known swirling devices adopted for such purposes include a swirl chamber having a plurality of substantially tangentially directed, substantially straight inlet ducts through which the intake air is drawn into the swirl chamber to produce a swirl therein. The swirling intake air is then introduced into the combustion chamber. In case where four inlet ducts are provided, these ducts are arranged perpendicular to each other.

The conventional swirling device is however disadvantageous in that the intake air stream discharged from one of the inlet ducts interfere with the intake air from another inlet duct producing a substantial pressure loss. Further, such interference weakens the swirl of the intake air and prevents uniform mixing of fuel with the intake air resulting in an incomplete combustion of fuel. It should further be noted that the inlet ducts cannot provide a sufficient passage area for the intake air so that the intake air flow speed is unavoidably increased causing a substantial friction loss. In the conventional stirling cycle engine having the aforementioned swirling device, it has been required to use a blower of a high capacity in order to compensate for the pressure loss, the incomplete combustion and the friction loss.

OBJECT OF THE INVENTION

It is an object of the present invention to provide a swirling device for a stirling cycle engine which can produce a strong swirl of the intake air with a decreased pressure loss.

Another object of the present invention is to provide a swirling device for a stirling cycle engine which has inlet means which can introduce the intake air with a decreased friction loss.

A further object of the present invention is to provide a swirling device for a stirling cycle engine in which the aforementioned problems are overcome.

SUMMARY OF THE INVENTION

According to the present invention, the above and other objects can be accomplished by a swirling device for a stirling cycle engine including a pair of spaced apart, substantially parallel plates, said plates being respectively formed with central apertures which respectively have centers and are substantially aligned with each other, a plurality of spiral guide vanes disposed between said parallel plates, each of said guide vanes having a curvature in which a tangential line at a point on said guide vane makes with a straight line passing through said point and said center of the central aperture an angle which is substantially constant and between 30° and 80° so that each two adjacent guide vanes define an inlet passage which is gradually decreased in area toward the central aperture.

According to the present invention, there is further provided a burner for a stirling cycle engine, said burner including an air inlet port, an exhaust port and a combustion chamber between said inlet and exhaust ports, said combustion chamber having an inlet provided with a swirling device which comprises a pair of spaced apart, substantially parallel plates respectively formed with central apertures respectively having centers which are substantially aligned with each other, a plurality of spiral guide vanes disposed between said parallel plates, each of said guide vanes having a curvature in which a tangent line at a point on said guide vane makes with a straight line passing through said point and said center of the central aperture an angle which is substantially constant and between 30° and 80° so that each two adjacent guide vanes define an inlet passage which is gradually decreased toward the central aperture, said inlet passage being communicated at an end adjacent to said central apertures with said combustion chamber and at the other end with said inlet port, fuel injection means located in an area defined by said central apertures of said plates.

According to the features of the present invention, the intake air flows from the radially outward ends of the inlet passages along the spiral configurations of the guide vanes to the radially inward ends of the inlet passages. The air flow speed is gradually increased in the inlet passages since the passages are gradually decreased in areas and discharged into the area defined by the central apertures of the plate in spiral directions producing a strong and uniformly distributed swirl of the intake air. Thus, it is possible to ensure a uniform mixing of fuel with the air so that a substantially complete combustion is performed. Further, the swirl ensures a uniform distribution of combustion flame and decrease temperature difference in the combustion chamber. It is therefore possible to avoid any local overheat so that the life of the burner is increased.

DESCRIPTIONS OF THE PREFERRED EMBODIMENT

Figure 1:
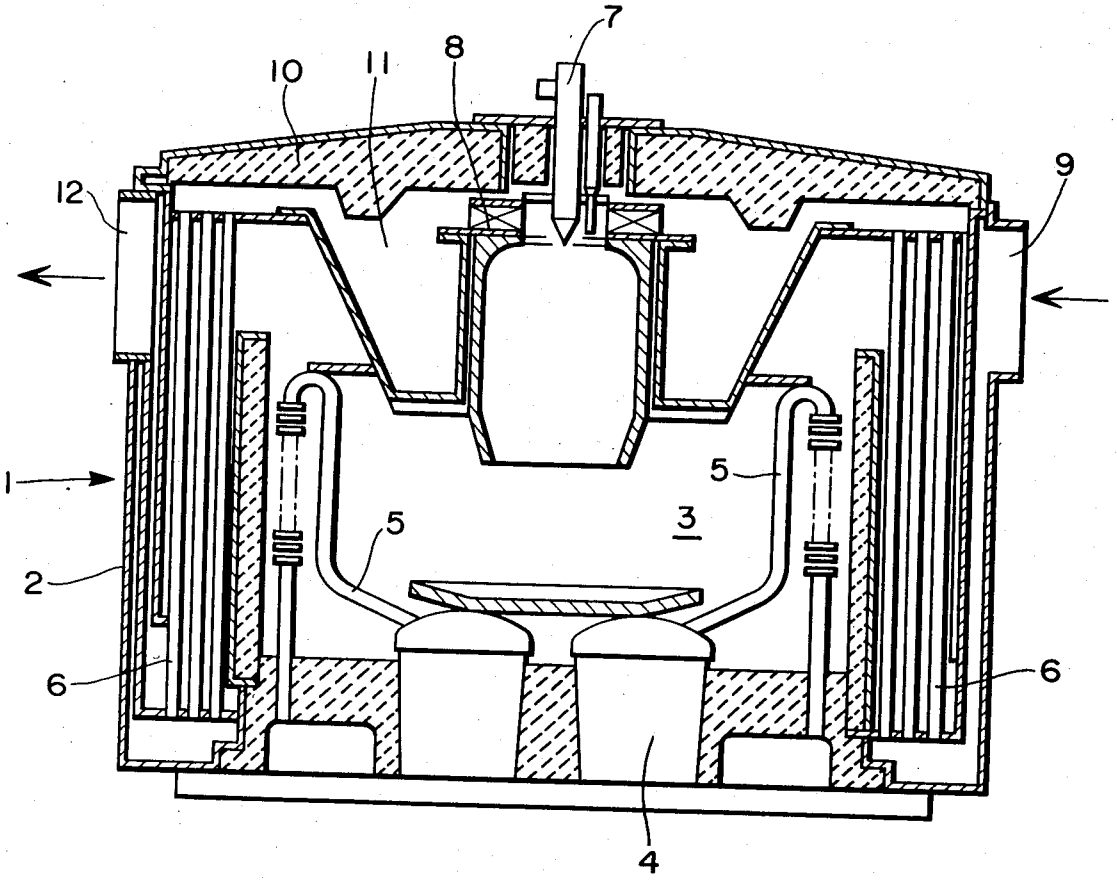
FIG. 1 is a vertical sectional view of a burner for a stirling cycle engine to which the present invention can be applied.

Referring to the drawings, particularly to FIG. 1, there is shown a part of a stirling cycle engine 1 having a burner 2. The burner 2 includes a combustion chamber 3 and heating pipes 5 arranged in the combustion chamber 3. The heating pipes 5 are connected with working cylinders 4 as in a conventional stirling cycle engine. The burner 2 is provided with an air inlet port 9 and an exhaust port 12. Around the combustion chamber 3, there is a preheater 6 which is located in the path of combustion gas from the combustion chamber 3 to the exhaust port 12. The inlet port 9 is connected also through the preheater 6 to an inlet chamber 11 formed beneath a top cover 10 of the burner 2. The inlet chamber 11, is in turn connected through a swirling device 8 to the combustion chamber 3 so that the intake air from the inlet port 9 is preheated by the combustion gas before it is introduced into the combustion chamber 3. A fuel injection nozzle 7 is provided in the swirling device 8.

Figure 2:
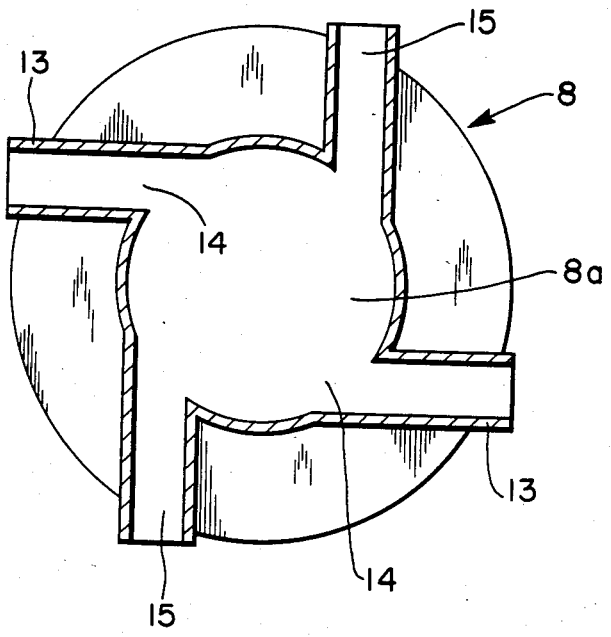
FIG. 2 PRIOR ART
FIG. 2 is a sectional view of a swirling device in accordance with a conventional design, the section being taken along the line II—II in FIG. 3.
Figure 3:
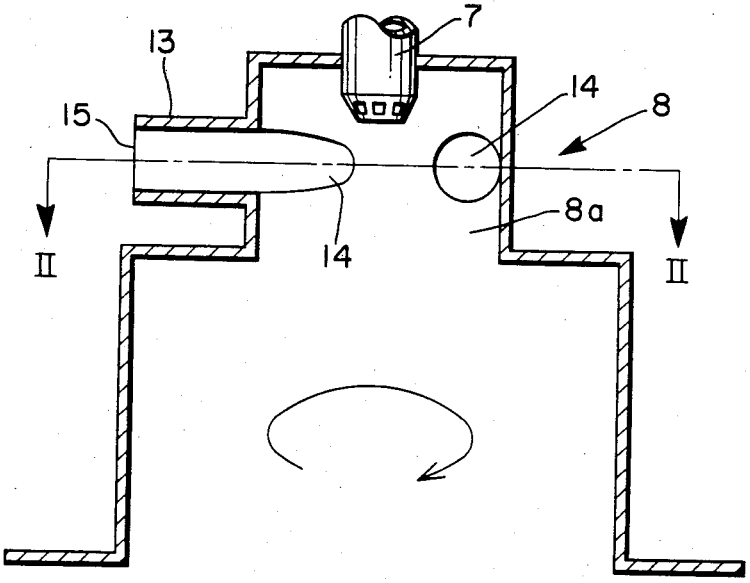
FIG. 3 PRIOR ART
FIG. 3 is a sectional view of the swirling device shown in FIG. 2, the section being taken along a plane perpendicular to the plane of FIG. 2.

Referring now to FIGS. 2 and 3, there is shown an example of a conventional swirling device 8. The swirling device 8 includes a circular swirl chamber 8*a* having four substantially tangentially directed inlet ducts 13 which extend substantially perpendicularly with each other. Each of the inlet ducts 13 has an inlet end 15 opened to the inlet chamber 11 and an outlet end 14 opened to the swirl chamber 8*a*. The fuel injection nozzle 7 is provided to inject fuel to the swirl chamber 8*a*. The swirling device 8 of this design has disadvantages as pointed out previously.

Figure 4:
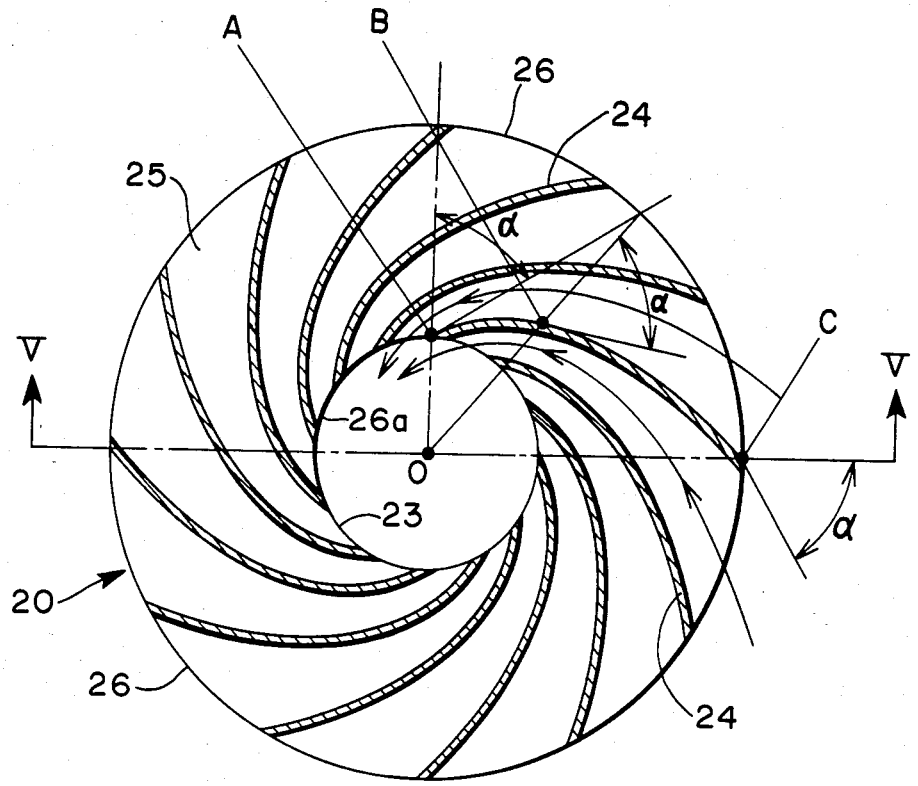
FIG. 4 is a sectional view similar to FIG. 2 but showing one embodiment of the present invention; and, FIG. 5 is a sectional view taken substantially along the line V—V in FIG. 4.
Figure 5:
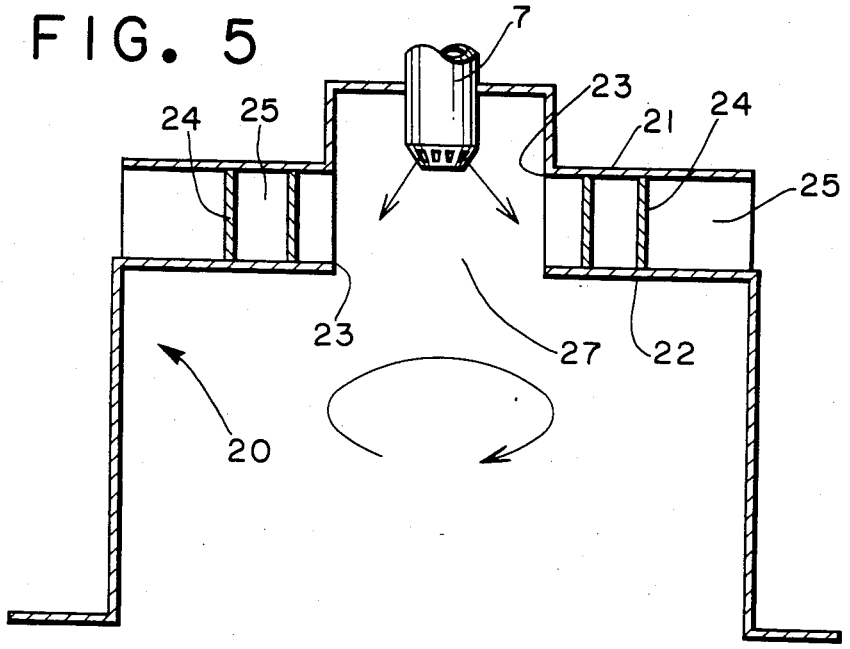

Referring now to FIGS. 4 and 5, there is shown one embodiment of the present invention which is designated generally by a reference numeral 20. The swirling device 20 includes a pair of spaced apart, parallel plates 21 and 22 which have central apertures 23 vertically aligned with each other. Between the plates 21 and 22, there are a plurality of spiral guide vanes 24 which extend from the outer periphery of the plate to the central aperture 23. Thus, there is defined an air inlet passage 25 having an inlet end 26 and an outlet end 26*a* between each two adjacent guide vanes 24. Each of the guide vanes 24 has a curvature in which a tangent line at any point, for example, the point A, B or C on the guide vane 24 makes, together with a straight line passing through the point and the center 0 of the central aperture 23, an angle $\alpha$ which is substantially constant and between 30° and 80°. Thus, the inlet passage 25 has a wide inlet and is gradually decreased in area toward the outlet end. The intake air is therefore introduced from the inlet chamber 11 to the inlet passages 25 without being decreased in speed but the speed of the intake air flow is gradually increased in the passages 25 and discharged into the swirl chamber 27 defined in the central apertures 23 along the directions of the guide vanes 24 to produce a strong swirl therein.

The invention has thus been shown and described with reference to a specific embodiment, however, it should be noted that the invention is in no way limited to the details of the illustrated structures but changes and modifications may be made without departing from the scope of the appended claims.

We claim:

1. A burner for a stirling cycle engine which includes air inlet port means, exhaust port means and combustion chamber means between said inlet port means and said exhaust port means, said combustion chamber means having inlet means provided with swirl producing means including a pair of spaced apart, substantially parallel plates, each of said plates being formed with a central aperture, said apertures having centers and being substantially aligned with each other, a plurality of spiral guide vanes disposed between said plates, each of said guide vanes having a curvature in which a tangent line at any point on said guide vane makes an angle with a straight line passing through said point and said center of the central aperture, said angle being substantially constant and being between 60° and 70°, each two adjacent guide vanes defining an inlet passage which is gradually decreased in area toward the central aperture, said inlet passage being communicated at an end adjacent to said central apertures with said combustion chamber means and at the other end with said inlet port means, said central apertures defining a swirl chamber, said burner including fuel injection means located in said swirl chamber, whereby mixing of fuel and air in said swirl chamber is enhanced.

* * * * *